US005900789A

United States Patent [19]

Yamamoto et al.

[11] Patent Number: 5,900,789

[45] Date of Patent: May 4, 1999

[54] IRREVERSIBLE CIRCUIT ELEMENT

[75] Inventors: Shinji Yamamoto, Yazu-gun; Koji Ichikawa, Oumiya, both of Japan

[73] Assignee: Hitachi Metals, Ltd., Tokyo, Japan

[21] Appl. No.: 08/898,834

[22] Filed: Jul. 23, 1997

[30] Foreign Application Priority Data

Jul. 26, 1996 [JP] Japan ..... 8-197177

[51] Int. Cl.[6] ..... H01P 1/383

[52] U.S. Cl. ..... 333/1.1; 335/302

[58] Field of Search ..... 333/1.1, 24.1–24.3; 335/281, 282, 302, 304, 306; 336/110

[56] References Cited

U.S. PATENT DOCUMENTS 3,185,941 5/1965 Freiberg ..... 333/1.1

3,662,291 5/1972 Cotter ..... 333/1.1

5,159,294 10/1992 Ishikawa et al. ..... 333/1.1

FOREIGN PATENT DOCUMENTS 6-164211 6/1994 Japan .

6-204712 7/1994 Japan .

7-106809 4/1995 Japan .

*Primary Examiner*—Paul Gensler

[57] ABSTRACT

A magnetic yoke also serves as a case for an irreversible circuit element. The magnetic yoke has a surface which is covered with such a high-conductivity metal coating film that an electric resistivity is 5.5 μΩ cm or less. Thereby, a signal energy is efficiently maintained. An input signal is transmitted to an output terminal with less loss.

18 Claims, 1 Drawing Sheet

IRREVERSIBLE CIRCUIT ELEMENT

BACKGROUND OF THE INVENTION (1.) Field of the Invention

The present invention relates to an irreversible circuit element having an irreversible transmission character relative to a high-frequency signal. More specifically, the present invention relates to an irreversible circuit element for use in a mobile communication system such as a portable telephone, generally referred to as an isolator and a circulator.

(2.) Description of the Related Art

Users of a portable telephone and a mobile telephone have recently increased in number with an increase of their coverage area and a smaller size of an equipment for them. One main component of the portable telephone, the mobile telephone and the like is an irreversible circuit element. The irreversible circuit element allows a signal to be passed in a transmission direction alone, and it prevents the signal from being transmitted in an opposite direction. The irreversible circuit element is referred to as a circulator and an isolator.

When the irreversible circuit element is inserted into its circuit system, a loss of a signal power to be transmitted occurs. Accordingly, the irreversible circuit element is heated, and battery consumption is increased. Many attempts have been made to efficiently operate the irreversible circuit element without losing a high-frequency signal and to reduce a signal power loss.

For example, in Japanese Patent Laid-Open No. 7-106809/1995, a loop strip line to be resistance-connected has a different width from the width of other loop strip lines whereby an impedance mismatch which is caused by a resistance connection is corrected. That is, a design of a central conductive material attempts to solve the above problem.

Furthermore, in Japanese Patent Laid-Open No. 6-164211/1994, an auxiliary ferrite is disposed whereby the design of a magnetic circuit attempts to solve the problem.

Furthermore, in Japanese Patent Laid-Open No. 6-204712/1994, an earth potential of a yoke achieves a reduction of power loss. The yoke is used to form an outermost of the irreversible circuit element. The yoke holds many components which are incorporated in the irreversible circuit element so that they may be positioned in place. In addition, the yoke serves not only as a case for protecting the components but also as one part of the magnetic circuit which the whole irreversible circuit element is composed of. The yoke also has an electric shield effect so that it may reduce an interference between an inside and an outside of the irreversible circuit element. When the power loss is high within the irreversible circuit element, the yoke plays an important role in efficiently dissipating the generated heat.

One of the most important functions is to efficiently construct the magnetic circuit having an excellent uniformity. Thus, a nickel-plated iron plate is generally used for a material of the yoke. Furthermore, the iron is silvered and the silvered iron is then coated with an insulating resin. The resultant is proposed as the lower yoke.

The above-described conventional magnetic yoke for the irreversible circuit element employs the nickel and the iron which have an intermediate electric conductivity as a metal material. Accordingly, the materials do not always have an excellent signal transmission efficiency for a high-frequency electric signal which is sensitive to the electric conductivity. More effectively, the base-metal iron is improved so that it may be replaced by the high-conductivity material. However, a performance for the magnetic circuit might be deteriorated.

SUMMARY OF THE INVENTION

It is an object of the present invention to provide, without reducing a performance for a conventional magnetic yoke, an irreversible circuit element which has a good signal transmission efficiency for a high-frequency electric signal which is sensitive to an electric conductivity.

It is another object of the present invention to provide an irreversible circuit element which can efficiently maintain a signal energy and can transmit an input signal to an output terminal with less loss.

It is a further object of the present invention to provide an irreversible circuit element wherein the magnetic yoke also serves as a case and the magnetic yoke surface is covered with a metal coating film which has such a high conductivity that an electric resistivity is 5.5 μΩ cm or less.

It is a still further object of the present invention to provide an irreversible circuit element wherein the magnetic yoke serving as the case is divided into at least two parts and the surface of the magnetic yoke having both the magnetic sides is covered with the metal coating film which has such a high conductivity that the electric resistivity is 5.5 μΩ cm or less.

It is a still further object of the present invention to provide an irreversible circuit element wherein the magnetic yoke serving as the case is divided into at least two parts and the magnetic yoke surface, which at least a magnet is mounted to, is covered with the metal coating film which has such a high conductivity that the electric resistivity is 5.5 μΩ cm or less.

It is a still further object of the present invention to provide an irreversible circuit element wherein the metal coating film is formed on 60% or more of all the inner area of the magnetic yoke.

It is a still further object of the present invention to provide an irreversible circuit element wherein the metal coating film is 0.5 to 25 μm in thickness.

It is a still further object of the present invention to provide an irreversible circuit element wherein the metal coating film is a metal or an alloy which contains at least one of a silver, a copper, a gold and an aluminum.

It is a still further object of the present invention to provide an irreversible circuit element wherein the metal coating film is covered with another conductive metal protective coating film.

It is a still further object of the present invention to provide an irreversible circuit element wherein the magnetic yoke has a base metal which is a metal plate whose main component is the iron having a thickness of 120 to 240 μm.

Other objects of the present invention will be readily understood from the description and attached claims with reference to the accompanying drawing.

DETAILED DESCRIPTION OF THE PREFERRED EMBODIMENTS

Figure 1:
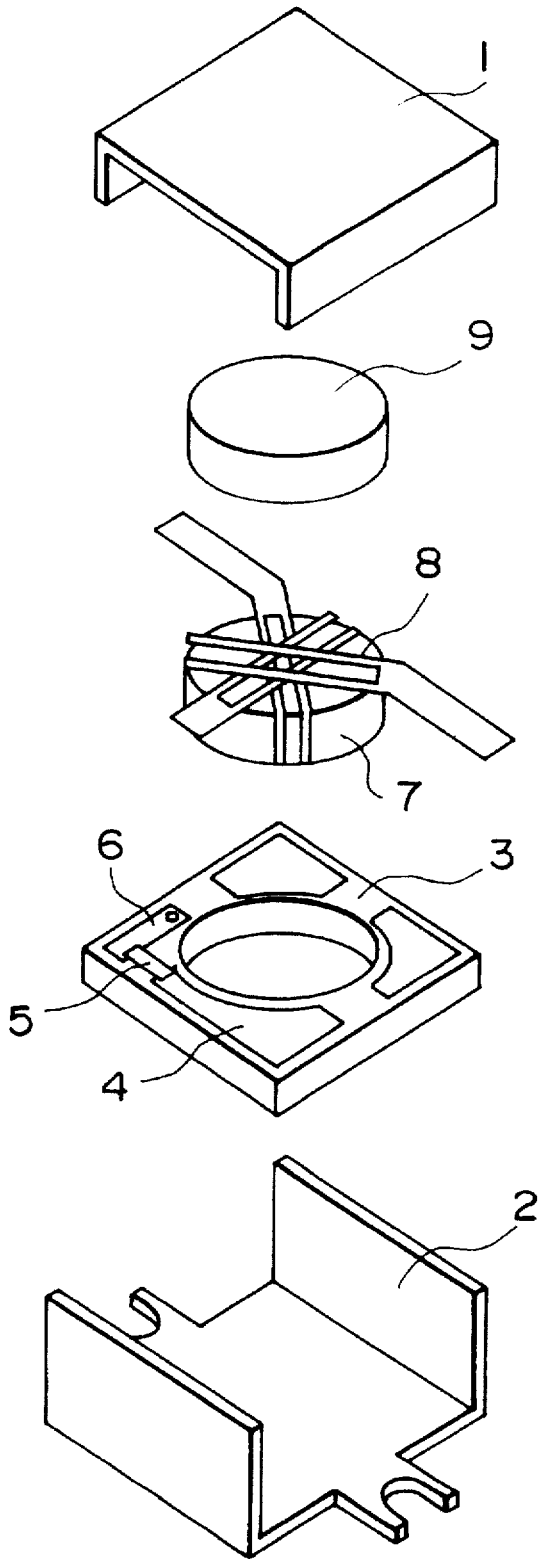
FIG. 1 shows a structure of an embodiment according to the present invention.

Hereinafter, a preferred embodiment of the present invention will be described in detail with reference to the accompanying drawing.

In the present invention, a magnetic yoke also serves as a case for an element. In order to improve a signal transmission efficiency of an irreversible circuit element and to suppress an interference between an inside and an outside of the element, on a surface of the magnetic yoke is formed a metal coating film which has such a high conductivity that an electric resistivity is 5.5 μΩ cm or less. Thus, a reduction of loss is effectively achieved. Preferably, the electric resistivity is 3.0 μΩ cm or less. More preferably, the electric resistivity is 1.8 μΩ cm or less. In addition, the magnetic yoke serving as the case is often divided into some parts for consideration of an assembly. In such a case that the yoke is divided, preferably, the metal coating film is similarly formed on both the magnetic yokes. More preferably, the metal coating film is formed on the magnetic yoke which at least a magnet is mounted to.

However, in a method of forming a coating film as described below which is industrially put to practical use, it is often difficult to uniformly form the high-conductivity metal coating film, which is not practical. In this case, the high-conductivity metal coating film can only be formed on the magnetic yoke surface which includes at least 60% or more of all the inner surface area of the magnetic yoke which serves as the case for the element.

In order to further improve the signal transmission efficiency of the irreversible circuit element, ideally, the high-conductivity metal coating film is disposed on all the magnetic yoke which serves as the divided case.

However, when various components are assembled in the yoke to which the magnet cannot be mounted and the components are soldered so as to fix them to the yoke, the components cannot sometimes be fixed to the yoke due to a bad wettability to a soldering. In this case, the high-conductivity metal coating film may be disposed on the yoke alone, which enables the magnet to be mounted to, in the divided-case magnetic yoke. Although an improved effect of the signal transmission efficiency is little degraded, this facilitates and ensures that various components are assembled in the yoke which the magnet cannot be mounted to and the components are soldered so as to fix them to the yoke.

In this case, as described above, it is often difficult to uniformly form the high-conductivity metal coating film. The high-conductivity metal coating film can only be formed on the yoke surface which includes at least more or 60% of all the inner area of the yoke surface which the magnet can be mounted to in the divided element case magnetic yoke.

For a method of manufacturing the irreversible circuit element by forming a thin surface coating film as described above, a wet soldering process has been heretofore put to practical use and it is easily performed. In a dry process, a practical manufacturing method such as a vacuum deposition process and a sputtering process are industrially established, and they are easily performed.

In the present invention, preferably, the high-conductivity metal coating film has the thickness ranging from 0.5 to 25 μm. It is relatively easy to ensure this thickness on the complicated-shaped magnetic yoke. In case of the metal coating film such as an aluminum which does not have a very high conductivity, the thickness is similarly set to 0.5 to 25 μm whereby a desired effect can be obtained. The high-frequency electric signal flows on the surface alone due to a skin effect. Accordingly, such a thin film is sufficient to use it for the metal coating film. Even if the film thickness is more than 25 μm, the signal transmission efficiency for the element is not further improved. On the contrary, when the thickness is more than 25 μm, the more than 25 μm thickness is not preferable since the coating film is sometimes cracked due to a stress and the like. When the thickness is less than 0.5 μm, the improved effect of the signal transmission efficiency cannot be sufficiently achieved. Preferably, the thickness ranges from 0.5 to 10 μm. More preferably, the thickness ranges from 1 to 8 μm.

In the present invention, when the particularly low-conductivity metal coating film such as a silver and a copper is used and when the metal coating film thickness can be strictly controlled, the metal coating film thickness preferably ranges from 2 to 8 μm. When the thickness is 2 μm or more, the improved effect of the signal transmission efficiency can be further enhanced. Even if the thickness is increased to 8 μm or more, the thickness up to 8 μm is practically sufficient since the signal transmission efficiency is not greatly improved. More preferably, the thickness ranges from 4 to 7 μm.

This value is consistent with a theoretical result as calculated by the following equation, where ω, μ, ρ denote an angular frequency, a permeability and the electric resistivity, respectively.

$$\text{Skin thickness}=(2/\omega\mu\rho)^{+e,fra\ 12+oe} \qquad \text{equation (1)}$$

In the present invention, the electric resistivity is required to be 5.5 μΩ cm or less for the high-conductivity metal coating film. The high-conductivity metal coating film for use in the present invention is a metal or an alloy which contains at least one of the silver, the copper, a gold and the aluminum. In case of these materials, a high-quality material is commercially available with ease. However, since the metal coating film which mainly contains the silver, the copper, the gold and the aluminum has a low hardness, it might be damaged by a slight mechanical friction and the like. After such a metal coating film is used for a long period, the surface is so oxidized that the surface is color-changed. Such a negative factor is not so serious as to reduce an electric signal transmission character of the irreversible circuit element. However, preferably, the metal coating film is covered with and protected by another conductive protective coating film for the reason that its appearance is kept beautiful and the like.

For such a conductive protective coating film, a nickel and a chrome-plate are easy and are also industrially established. The coating film thickness is required to range from 0.2 to 2 μm. When the thickness is less than 0.2 μm, it is not sufficient for a mechanical protection and an anti-oxidization. In addition, in the wet soldering process, since the film thickness is too thin to control the thickness, the thinner thickness is not practical. When the thickness is more than 2 μm, the electric signal transmission character of the irreversible circuit element might be reduced due to the skin effect of the high-frequency electric signal described above. Preferably, the thickness ranges from 0.2 to 1.5 μm.

In the present invention, the magnetic yoke is divided into two parts or more and the elements are fixed to the yoke by welding or soldering after they are assembled so that the formation of the thin surface coating film and the assembly of the elements may be easily surely carried out. A method of dividing the yoke is most easily practically accomplished by dividing the yoke into an upper portion and a lower portion. Preferably, the welding of the elements is accomplished by an ultrasonic welding and a spot electric welding so as not to give the irreversible circuit element a thermal shock.

In the present invention, it is good that a base metal of the magnetic yoke is a metal plate whose main component is an iron having the thickness of 120 to 240 μm. This range of thickness is desirable so as to balance with a magnetic force of the magnet for usual use in the irreversible circuit element. Since the magnetic yoke also serves as the case, the thickness less than 120 μm is not enough to protect the element from various external mechanical shocks. If the thickness is more than 240 μm, operation is difficult and it is difficult to maintain a dimensional accuracy. Moreover, it is difficult to keep a whole size of the irreversible circuit element small. Preferably, the thickness ranges from 170 to 230 μm.

EMBODIMENTS

The present invention will be described with reference to the following embodiments.

Referring now to FIG. 1, there is shown a structure of an irreversible circuit element according to the present invention. The embodiment shown in FIG. 1 is a concentrated constant type isolator. A magnetic yoke also serves as a case. The magnetic yoke is divided into two portions, that is, an upper portion and a lower portion. The magnetic yoke comprises an upper case (upper yoke) 1 and a lower case (lower yoke) 2. A dielectric substrate 3 is arranged on the lower case 2 so as to be used as a capacitor element. An electrode 6 is formed on the dielectric substrate 3. An electrostatic capacity is comprised of the electrode 6. A central conductive portion is inserted into a through hole at the center of the dielectric substrate 3. The central conductive portion comprises three central conductive materials 8 which are mutually insulated and arranged in a disc garnet 7 which is used as a signal direction control member. The central conductive portion is referred to as a microwave strip line. A permanent magnet 9 is attached to the upper case 1. The permanent magnet 9 is used so that the upper and lower cases may be spliced to each other. A dummy resistance 5 is connected to one electrode 4 which constructs the capacity of the dielectric substrate. The dummy resistance 5 is connected to an earth electrode 6. Without the dummy resistance 5, an external terminal is disposed like other central conductive materials, thereby resulting in a circulator.

Since an inside construction of the irreversible circuit element includes various constructions, the present invention is not particularly limited to the above construction. For example, the electrostatic capacity may use a chip capacitor. The dummy resistance 5 may use a chip resistance or two garnets. The printed central conductive material may be used.

Embodiment 1

In the structure shown in FIG. 1, the lower case 2 is solder-plated. The solder-plating is performed in thickness up to 5 μm. The upper case 1 is copper-plated in thickness up to 6 μm so as to be used. When a signal transmission character is measured, a signal loss is −0.49 dB. An evaluation of this embodiment is shown in Table 1. The evaluation of the following embodiments and comparison examples are similarly shown in Table 1.

Embodiment 2

Similarly, the lower case 2 is solder-plated. The solder-plating is performed in thickness up to 5 μm. The upper case 1 is silver-plated in thickness up to 6 μm so as to be used. When the signal transmission character is measured, the signal loss is −0.49 dB.

Embodiment 3

Similarly, the lower case 2 is solder-plated. The solder-plating is performed in thickness up to 5 μm. The upper case 1 is gold-plated in thickness up to 6 μm so as to be used. When the signal transmission character is measured, the signal loss is −0.52 dB.

Embodiment 4

Similarly, the lower case 2 is solder-plated. The solder-plating is performed in thickness up to 5 μm. The upper case 1 is aluminum-dry-vacuum-plated in thickness up to 6 μm so as to be used. When the signal transmission character is measured, the signal loss is −0.53 dB.

Embodiment 5

Similarly, the lower case 2 is solder-plated. The solder-plating is performed in thickness up to 5 μm. The upper case 1 is aluminum-alloy, that is, aluminum-magnesium-silicon dry-vacuum-plated so as to be used. The upper case, to which the magnet is mounted, is aluminum-alloy vacuum-plated in thickness up to 6 μm. When the signal transmission character is measured, the signal loss is −0.53 dB.

Comparison Example 1

Similarly, the lower case 2 is solder-plated. The solder-plating is performed in thickness up to 5 μm. The upper case 1 is brass-vacuum-plated so as to be used. The brass-vacuum-plating is performed in thickness up to 25 μm. When the signal transmission character is measured, the signal loss is −0.61 dB.

Comparison Example 2

Similarly, the lower case 2 is solder-plated. The solder-plating is performed in thickness up to 5 μm. The upper case 1 is nickel-plated so as to be used. The nickel-plating is performed in thickness up to 6 μm. When the signal transmission character is measured, the signal loss is −0.62 dB.

Comparison Example 3

Similarly, the lower case 2 is solder-plated. The solder-plating is performed in thickness up to 5 μm. The upper case 1 is also solder-plated so as to be used. The solder-plating is performed in thickness up to 6 μm. When the signal transmission character is measured, the signal loss is −0.65 dB.

Comparison Example 4

Similarly, the lower case 2 is solder-plated. The solder-plating is performed in thickness up to 5 μm. The upper case 1 is not plated at all so as to be used. That is, a yoke base metal, an iron itself is used. When the signal transmission character is measured, the signal loss is −0.64 dB.

Embodiment 6

Similarly, the lower case 2 is solder-plated. The solder-plating is performed in thickness up to 5 μm. A partial outer surface and all the inner surface of the upper case 1 are copper-vacuum-plated so as to be used. The copper-plating is performed in thickness up to 5 μm. When the signal transmission character is measured, the signal loss is −0.50 dB.

Embodiment 7

Similarly, the lower case 2 is solder-plated. The solder-plating is performed in thickness up to 5 μm. The partial outer surface and about 80% of all the inner surface of the upper case 1 are copper-vacuum-plated so as to be used. The copper-plating is performed in thickness up to 5 μm. When the signal transmission character is measured, the signal loss is −0.52 dB.

Embodiment 8

Similarly, the lower case 2 is solder-plated. The solder-plating is performed in thickness up to 5 μm. The partial outer surface and about 60% of all the inner surface of the upper case 1 are copper-vacuum-plated so as to be used. The copper-plating is performed in thickness up to 5 μm. When the signal transmission character is measured, the signal loss is −0.55 dB.

Comparison Example 5

Similarly, the lower case 2 is solder-plated. The solder-plating is performed in thickness up to 5 μm. The partial outer surface and about 40% of all the inner surface of the upper case 1 are copper-vacuum-plated so as to be used. The copper-plating is performed in thickness up to 5 μm. When the signal transmission character is measured, the signal loss is −0.61 dB.

Embodiment 9

Similarly, all the outer and inner surfaces of all the yokes (upper and lower cases) are silver-plated so as to be used. The silver-plating is performed in thickness up to 6.5 μm. When the signal transmission character is measured, the signal loss is −0.45 dB.

Embodiment 10

Similarly, almost all the outer surface and about 80% of all the inner surface of all the yokes (upper and lower cases) are silver-plated so as to be used. The silver-plating is performed in thickness up to 6.5 μm. When the signal transmission character is measured, the signal loss is −0.48 dB.

Embodiment 11

Similarly, almost all the outer surface and about 60% of all the inner surface of all the yokes (upper and lower cases) are silver-plated so as to be used. The silver-plating is performed in thickness up to 6.5 μm. When the signal transmission character is measured, the signal loss is −0.51 dB.

Comparison Example 6

Similarly, almost all the outer surface and about 40% of all the inner surface of all the yokes (upper and lower cases) are silver-plated so as to be used. The silver-plating is performed in thickness up to 6.5 μm. When the signal transmission character is measured, the signal loss is −0.56 dB.

Embodiment 12

Similarly, all the yokes (upper and lower cases) are silver-plated. The silver-plating is performed in thickness up to 0.5 μm. When the signal transmission character is measured, the signal loss is −0.55 dB.

Embodiment 13

Similarly, all the yokes (upper and lower cases) are silver-plated. The silver-plating is performed in thickness up to 1 μm. When the signal transmission character is measured, the signal loss is −0.50 dB.

Embodiment 14

Similarly, all the yokes (upper and lower cases) are silver-plated. The silver-plating is performed in thickness up to 2 μm. When the signal transmission character is measured, the signal loss is −0.47 dB.

Embodiment 15

Similarly, all the yokes (upper and lower cases) are silver-plated. The silver-plating is performed in thickness up to 4 μm. When the signal transmission character is measured, the signal loss is −0.46 dB.

Embodiment 16

Similarly, all the yokes (upper and lower cases) are silver-plated. The silver-plating is performed in thickness up to 8 μm. When the signal transmission character is measured, the signal loss is −0.45 dB.

Embodiment 17

Similarly, all the yokes (upper and lower cases) are silver-plated. The silver-plating is performed in thickness up to 25 μm. When the signal transmission character is measured, the signal loss is −0.45 dB.

Comparison Example 7

Similarly, all the yokes (upper and lower cases) are silver-plated. The silver-plating is performed in thickness up to 0.3 μm. When the signal transmission character is measured, the signal loss is −0.58 dB.

Comparison Example 8

Similarly, all the yokes (upper and lower cases) are silver-plated. The silver-plating is performed in thickness up to 30 μm. When the signal transmission character is measured, the signal loss is a preferable value such as −0.45 dB. However, in the process that the yoke is heated by the soldering and the like during the assembly, a silver-plated film is cracked to such an extent that the cracking can be recognized by a microscope.

Embodiment 18

Similarly, all the surface of all the combined yokes (upper and lower cases) are copper-plated. The copper-plating on the yoke surface is performed in thickness up to 6 μm. The copper-plated coating film is nickel-plated so as to protect the copper-plated coating film. The nickel-plating is performed in thickness up to 0.5 μm. When the signal transmission character is measured, the signal loss is −0.48 dB.

Embodiment 19

Similarly, all the surface of all the combined yokes (upper and lower cases) are copper-plated so as to be used. The copper-plating on the yoke surface is performed in thickness up to 6 μm. The copper-plated coating film is permalloy-plated so as to protect the copper-plated coating film. The permalloy-plating is performed in thickness up to 0.5 μm. When the signal transmission character is measured, the signal loss is −0.48 dB.

Embodiment 20

Similarly, all the surface of all the combined yokes (upper and lower cases) are copper-plated so as to be used. The copper-plating on the yoke surface is performed in thickness up to 6 μm. The copper-plated coating film is nickel-plated so as to protect the copper-plated coating film. The nickel-plating is performed in thickness up to 1.4 μm. When the signal transmission character is measured, the signal loss is −0.51 dB.

Embodiment 21

Similarly, all the surface of all the combined yokes (upper and lower cases) are copper-plated so as to be used. The copper-plating on the yoke surface is performed in thickness up to 6 μm. The copper-plated coating film is nickel-plated so as to protect the copper-plated coating film. The nickel-plating is performed in thickness up to 2 μm. When the signal transmission character is measured, the signal loss is −0.53 dB.

Comparison Example 9

Similarly, all the surface of all the combined yokes (upper and lower cases) are copper-plated so as to be used. The copper-plating on the yoke surface is performed in thickness up to 6 μm. The copper-plated coating film is nickel-plated so as to protect the copper-plated coating film. The nickel-plating is performed in thickness up to 4 μm. When the signal transmission character is measured, the signal loss is −0.59 dB.

Embodiment 22

Similarly, all the surface of all the combined yokes (upper and lower cases) are copper-plated so as to be used. The copper-plating on the yoke surface is performed in thickness up to 5.5 μm. A 200-μm-thick iron material is used for the base metal of all the yokes. When the signal transmission character is measured, the signal loss is −0.45 dB.

Embodiment 23

The irreversible circuit element is assembled in the same way as Embodiment 22 except that the 240-μm-thick iron material is used for the base metal of all the yokes (upper and lower cases). When the signal transmission character is measured, the signal loss is −0.43 dB.

Embodiment 24

The irreversible circuit element is assembled in the same way as Embodiment 22 except that a 200-μm-thick permalloy material is used for the base metal of all the yokes (upper and lower cases). When the signal transmission character is measured, the signal loss is −0.46 dB.

Embodiment 25

The irreversible circuit element is assembled in the same way as Embodiment 22 except that the 240-μm-thick permalloy material is used for the base metal of all the yokes (upper and lower cases). When the signal transmission character is measured, the signal loss is −0.45 dB.

Comparison Example 10

The irreversible circuit element is assembled in the same way as Embodiment 22 except that the 100-μm-thick iron material is used for the base metal of all the yokes (upper and lower cases). When the signal transmission character is measured, the signal loss is −0.64 dB.

Comparison Example 11

The irreversible circuit element is assembled in the same way as Embodiment 22 except that the 250-μm-thick iron material is used for the base metal of all the yokes (upper and lower cases). When the signal transmission character is measured, the signal loss is −0.43 dB. The character is good. However, since the base metal is thick, it is difficult to form a cross section at a fine right angle at a fine bending portion when the iron-material yoke is worked. Since the base metal is thick, the size of the whole irreversible circuit element is increased.

Embodiment 26

Similarly, all the combined yokes (upper and lower cases) are first copper-plated. The copper-plated yokes are then silver-plated. The base copper-plating is performed in thickness up to 2 μm. The silver-plating on the copper-plated film is performed in thickness up to 4 μm. The silver-plated coating film is nickel-plated in thickness up to 0.5 μm so as to protect the silver-plated coating film. When the signal transmission character is measured, the signal loss is −0.47 dB.

TABLE 1

| Comparison example Embodiment | High-conductivity coating film material | Portion where high-conductivity coating film is formed | Coating ratio of inner area of high-conductivity coating film(%) | Thickness of high-conductivity coating film(μm) | Electric resistivity of high-conductivity coating film(μΩcm) | Protect coating film material formed on high-conductivity coating film | Thickness of protect coating film | Case base metal material | Thickness of case base metal | Loss level of electric signal | joint between upper and lower cases | Appearance problem |
|---|---|---|---|---|---|---|---|---|---|---|---|---|
| Embodiment 1 | Copper with magnet | Surface of yoke | 100 | 6 | 1.9 | No | — | Iron | 200 | −0.49 | Only matched | No |
| Embodiment 2 | Silver with magnet | Surface of yoke | 100 | 6 | 1.8 | No | — | Iron | 200 | −0.49 | Only matched | No |
| Embodiment 3 | Gold with magnet | Surface of yoke | 100 | 6 | 2.5 | No | — | Iron | 200 | −0.52 | Only matched | No |
| Embodiment 4 | Aluminum with magnet | Surface of yoke | 100 | 6 | 2.9 | No | — | Iron | 200 | −0.53 | Only matched | No |
| Embodiment 5 | Aluminum alloy (Al—Mg—Si) | Surface of yoke with magnet | 100 | 6 | 3.1 | No | — | Iron | 200 | −0.53 | Only matched | No |
| Comparison example 1 | Brass (CuZn) | Surface of yoke with magnet | 100 | 25 | 6.1 | No | — | Iron | 200 | −0.61 | Only matched | No |
| Comparison example 2 | Nickel | Surface of yoke with magnet | 100 | 6 | 8.1 | No | — | Iron | 200 | −0.62 | Only matched | No |
| Comparison example 3 | Soldered | Surface of yoke with magnet | 100 | 6 | 11.2 | No | — | Iron | 200 | −0.65 | Only matched | No |
| Comparison Example 4 | No | — | — | — | — | No | — | Iron | 200 | −0.64 | Only matched | No |
| Embodiment 6 | Copper | Surface of yoke with magnet | 100 | 5 | 1.9 | No | — | Iron | 200 | −0.50 | All periphery soldered | No |
| Embodiment 7 | Copper | Surface of yoke with magnet | 80 | 5 | 1.9 | No | — | Iron | 200 | −0.52 | All periphery soldered | No |
| Embodiment 8 | Copper | Surface of yoke with magnet | 60 | 5 | 1.9 | No | — | Iron | 200 | −0.55 | All periphery soldered | No |
| Comparison example 5 | Copper | Surface of yoke with magnet | 40 | 5 | 1.9 | No | — | Iron | 200 | −0.61 | All periphery soldered | No |
| Embodiment 9 | Silver | All the yoke surface | 100 | 6.5 | 1.8 | No | — | Iron | 200 | −0.45 | All periphery soldered | No |
| Embodiment 10 | Silver | All the yoke surface | 80 | 6.5 | 1.8 | No | — | Iron | 200 | −0.48 | All periphery soldered | No |
| Embodiment 11 | Silver | All the yoke surface | 60 | 6.5 | 1.8 | No | — | Iron | 200 | −0.51 | All periphery soldered | No |
| Comparison example 6 | Silver | All the yoke surface | 40 | 6.5 | 1.8 | No | — | Iron | 200 | −0.56 | All periphery soldered | No |
| Embodiment 12 | Silver | All the yoke surface | 100 | 0.5 | 1.8 | No | — | Iron | 200 | −0.55 | All periphery soldered | No |
| Embodiment 13 | Silver | All the yoke surface | 100 | 1 | 1.8 | No | — | Iron | 200 | −0.50 | All periphery soldered | No |
| Embodiment 14 | Silver | All the yoke surface | 100 | 2 | 1.8 | No | — | Iron | 200 | −0.47 | All periphery soldered | No |
| Embodiment 15 | Silver | All the yoke surface | 100 | 4 | 1.8 | No | — | Iron | 200 | −0.46 | All periphery soldered | No |
| Embodiment | Silver | All the yoke | 100 | 8 | 1.8 | No | — | Iron | 200 | −0.45 | All periphery | No |

TABLE 1-continued

| Comparison example Embodiment | High-conductivity coating film material | Portion where high-conductivity coating film is formed | Coating ratio of inner area of high-conductivity coating film(%) | Thickness of high-conductivity coating film(μm) | Electric resistivity of high-conductivity coating film(μΩcm) | Protect coating film material formed on high-conductivity coating film | Thickness of protect coating film | Case base metal material | Thickness of case base metal | Loss level of electric signal | joint between upper and lower cases | Appearance problem |
|---|---|---|---|---|---|---|---|---|---|---|---|---|
| 16 | | surface | | | | | | | | | soldered | |
| Embodiment 17 | Silver | All the yoke surface | 100 | 25 | 1.8 | No | — | Iron | 200 | −0.45 | All periphery soldered | No |
| Comparison example 7 | Silver | All the yoke surface | 100 | 0.3 | 1.8 | No | — | Iron | 200 | −0.58 | All periphery soldered | No |
| Comparison example 8 | Silver | All the yoke surface | 100 | 30 | 1.8 | No | — | Iron | 200 | −0.45 | All periphery soldered | Crazing |
| Embodiment 18 | Copper | All the yoke surface | 100 | 6 | 1.9 | Nickel | 0.5 | Iron | 200 | −0.28 | All periphery soldered | No |
| Embodiment 19 | Copper | All the yoke surface | 100 | 6 | 1.9 | Permalloy | 0.5 | Iron | 200 | −0.48 | All periphery soldered | No |
| Embodiment 20 | Copper | All the yoke surface | 100 | 6 | 1.9 | Nickel | 1.4 | Iron | 200 | −0.51 | All periphery soldered | No |
| Embodiment 21 | Copper | All the yoke surface | 100 | 6 | 1.9 | Nickel | 2 | Iron | 200 | −0.53 | All periphery soldered | No |
| Comparison example 9 | Copper | All the yoke surface | 100 | 6 | 1.9 | Nickel | 4 | Iron | 200 | −0.59 | All periphery soldered | No |
| Embodiment 22 | Copper | All the yoke surface | 100 | 5.5 | 1.9 | No | — | Iron | 200 | −0.45 | All periphery soldered | No |
| Embodiment 23 | Copper | All the yoke surface | 100 | 5.5 | 1.9 | No | — | Iron | 240 | −0.43 | All periphery soldered | No |
| Embodiment 24 | Copper | All the yoke surface | 100 | 5.5 | 1.9 | No | — | Permalloy | 240 | −0.46 | All periphery soldered | No |
| Embodiment 25 | Copper | All the yoke surtface | 100 | 5.5 | 1.9 | No | — | Permalloy | 240 | −0.45 | All periphery soldered | No |
| Comparison example 10 | Copper | All the yoke surface | 100 | 5.5 | 1.9 | No | — | Iron | 100 | −0.64 | All periphery soldered | No |
| Comparison example 11 | Copper | All the yoke surface | 100 | 5.5 | 1.9 | No | — | Iron | 250 | −0.43 | All periphery soldered | Failure of bending |
| Embodiment 26 | Two layers of copper and silver | All the yoke surface | 100 | 2, 4 | 1.9 | Nickel | 0.5 | Iron | 200 | −0.47 | All periphery soldered | No |

According to the present invention, a loss level is −0.55 dB or less. The excellent characters are obtained. Although some comparison examples are included in any one of claims of the present invention, they are not included in other preferred claims. Accordingly, they are defined as the comparison examples.

The present invention is characterized by that the magnetic yoke also serves as the case. It is appreciated that the structure of the irreversible circuit element within the magnetic case is not particularly limited. For example, the irreversible circuit element comprises the garnet (ferrite), a plurality of central conductive materials, an electrostatic capacity component (capacitor), the magnet and the like.

According to the present invention, it is possible to obtain the high-reliability element which improves an electric signal loss of the irreversible circuit element and has no fear of an oxidization such as a color change after the element is used for a long period.

The present invention is not limited to the above embodiments. Various modifications can be made within the attached claims.

What is claimed is:

1. An irreversible circuit element comprising:

a magnetic yoke which also serves as a case; wherein said magnetic yoke has a surface which is covered with such a high-conductivity metal coating film that an electric resistivity is 5.5 μΩ cm or less.

2. The irreversible circuit element according to claim 1, wherein said magnetic yoke is divided into at least two parts.

3. The irreversible circuit element according to claim 1, wherein at least a magnet is mounted to said magnetic yoke.

4. The irreversible circuit element according to claim 1, wherein said metal coating film is formed in at least 60% of an inner area of said magnetic yoke.

5. The irreversible circuit element according to claim 1, wherein said metal coating film is 0.5 to 25 μm in thickness.

6. The irreversible circuit element according to claim 1, wherein said metal coating film is a metal or an alloy which contains at least one of a silver, a copper, a gold and an aluminum.

7. The irreversible circuit element according to claim 1, wherein said metal coating film is covered with another conductive metal protective coating film.

8. The irreversible circuit element according claim 1, wherein said magnetic yoke includes a base comprising a metal plate whose main component is an iron having a thickness of 120 to 240 μm.

9. An irreversible circuit element, comprising:

a signal direction control member;

a microwave strip line attached to said signal direction control member;

a capacity element connected to said microwave strip line;

a permanent magnet adjacent to said signal direction control member; and a magnetic yoke surrounding said signal direction control member, capacity element, microwave strip line and permanent magnet, wherein said magnetic yoke also serves as a case, the surface thereof is covered with such a high-conductivity metal coating film that an electric resistivity is 5.5 μΩ cm or less.

10. The irreversible circuit element according to claim 9, wherein said signal direction control member is a garnet plate.

11. The irreversible circuit element according to claim 9, wherein said capacity element is a dielectric substrate.

12. The irreversible circuit element according to claim 9, wherein said magnetic yoke is divided into at least two parts.

13. The irreversible circuit element according to claim 9, wherein at least said permanent magnet is mounted to said magnetic yoke.

14. The irreversible circuit element according to claim 9, wherein said metal coating film is formed in at least 60% of an inner area of said magnetic yoke.

15. The irreversible circuit element according to claim 9, wherein said metal coating film is 0.5 to 25 μm in thickness.

16. The irreversible circuit element according to claim 9, wherein said metal coating film is a metal or an alloy which contains at least one of a silver, a copper, a gold and an aluminum.

17. The irreversible circuit element according to claim 9, wherein said metal coating film is covered with another conductive metal protective coating film.

18. The irreversible circuit element according to claim 9, wherein said magnetic yoke includes a base comprising a metal plate whose main component is an iron having a thickness of 120 to 240 μm.

* * * * *

UNITED STATES PATENT AND TRADEMARK OFFICE

CERTIFICATE OF CORRECTION

PATENT NO.: 5,900,789
DATED : May 4, 1999
INVENTOR(S): Shinji Yamamoto, et al.

It is certified that error appears in the above-identified patent and that said Letters Patent is hereby corrected as shown below:

Column 4, equation (1) should be --Skin thickness $= (2/\omega\mu p)^{1/2}$.

Table 1, Column 2, line 6, delete "with magnet" insert in Column 3, line 6, --with magnet--;
Column 2, line 8, delete "with magnet" insert in Column 3, line 8, --with magnet--;
Column 2, line 10, delete "with magnet" insert in Column 3, line 10, --with magnet--;
Column 2, line 12, delete "with magnet" insert in Column 3, line 12, --with magnet--

Table 1 (Continued) Column 13, line 6, change "crazing" to --cracking--;
Column 11, line 11, change "-0.28" to -- -0.48--;
Column 10, line 25, change "240" to --200--.

Signed and Sealed this

Eleventh Day of January, 2000

*Attest:*

Q. TODD DICKINSON

*Attesting Officer*

*Acting Commissioner of Patents and Trademarks*